US006174078B1

(12) United States Patent
Ohm et al.

(10) Patent No.: US 6,174,078 B1
(45) Date of Patent: Jan. 16, 2001

(54) BOAT LIGHT SYSTEM

(76) Inventors: Steven T. Ohm, 32889 S. Kasson Rd., Tracy, CA (US) 95376; Louis J. Mordinoia, 16155 Via Catherine, San Lorenzo, CA (US) 94580

( * ) Notice: Under 35 U.S.C. 154(b), the term of this patent shall be extended for 0 days.

(21) Appl. No.: 09/345,850

(22) Filed: Jul. 1, 1999

(51) Int. Cl.[7] ..... B63B 45/06

(52) U.S. Cl. ..... 362/477; 362/219; 362/223; 362/225; 362/228; 114/343

(58) Field of Search ..... 362/477, 431, 362/219, 223, 225, 228; 340/984, 985; 114/343

(56) References Cited

U.S. PATENT DOCUMENTS 4,360,862 * 11/1982 Strasser et al. ..... 362/240
4,856,452 * 8/1989 Pingel et al. ..... 114/343
5,339,225 * 8/1994 Wiggerman ..... 362/477
5,704,704 * 1/1998 Reichard et al. ..... 362/431
5,711,591 * 1/1998 Jordan ..... 362/477

* cited by examiner

*Primary Examiner*—Alan Cariaso

(57) ABSTRACT

A boat light system for providing several different light sources in an easy to access single assembly. The boat light system includes a housing with opposite top and bottom ends. A lower extent downwardly extends from the bottom end of the housing. The lower extent has an electrical plug for electrically connecting to an electrical power supply. A pair of elongate light sources are mounted in the housing and electrically connected to the electrical plug. An upper extent is upwardly extended from the top end of the housing and has a stage coupled thereto. An upper light source is mounted to the stage and is electrically connected to the electrical plug.

11 Claims, 2 Drawing Sheets

BOAT LIGHT SYSTEM

BACKGROUND OF THE INVENTION

1. Field of the Invention

The present invention relates to boat lights and more particularly pertains to a new boat light system for providing several different light sources in an easy to access single assembly.

2. Description of the Prior Art

The use of boat lights is known in the prior art. More specifically, boat lights heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 3,502,861; 5,504,342; U.S. Pat. No. Des. 351,115; U.S. Pat. Nos. 5,711,591; 4,856,452; and 4,827,389.

While these devices fulfill their respective, particular objectives and requirements, the aforementioned patents do not disclose a new boat light system. The inventive device includes a housing with opposite top and bottom ends. A lower extent downwardly extends from the bottom end of the housing. The lower extent has an electrical plug for electrically connecting to an electrical power supply. A pair of elongate light sources are mounted in the housing and electrically connected to the electrical plug. An upper extent is upwardly extended from the top end of the housing and has a stage coupled thereto. An upper light source is mounted to the stage and is electrically connected to the electrical plug.

In these respects, the boat light system according to the present invention substantially departs from the conventional concepts and designs of the prior art, and in so doing provides an apparatus primarily developed for the purpose of providing several different light sources in an easy to access single assembly.

SUMMARY OF THE INVENTION

In view of the foregoing disadvantages inherent in the known types of boat lights now present in the prior art, the present invention provides a new boat light system construction wherein the same can be utilized for providing several different light sources in an easy to access single assembly.

The general purpose of the present invention, which will be described subsequently in greater detail, is to provide a new boat light system apparatus and method which has many of the advantages of the boat lights mentioned heretofore and many novel features that result in a new boat light system which is not anticipated, rendered obvious, suggested, or even implied by any of the prior art boat lights, either alone or in any combination thereof.

To attain this, the present invention generally comprises a housing with opposite top and bottom ends. A lower extent downwardly extends from the bottom end of the housing. The lower extent has an electrical plug for electrically connecting to an electrical power supply. A pair of elongate light sources are mounted in the housing and electrically connected to the electrical plug. An upper extent is upwardly extended from the top end of the housing and has a stage coupled thereto. An upper light source is mounted to the stage and is electrically connected to the electrical plug.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new boat light system apparatus and method which has many of the advantages of the boat lights mentioned heretofore and many novel features that result in a new boat light system which is not anticipated, rendered obvious, suggested, or even implied by any of the prior art boat lights, either alone or in any combination thereof.

It is another object of the present invention to provide a new boat light system which may be easily and efficiently manufactured and marketed.

It is a further object of the present invention to provide a new boat light system which is of a durable and reliable construction.

An even further object of the present invention is to provide a new boat light system which is susceptible of a low cost of manufacture with regard to both materials and labor, and which accordingly is then susceptible of low prices of sale to the consuming public, thereby making such boat light system economically available to the buying public.

Still yet another object of the present invention is to provide a new boat light system which provides in the apparatuses and methods of the prior art some of the advantages thereof, while simultaneously overcoming some of the disadvantages normally associated therewith.

Still another object of the present invention is to provide a new boat light system for providing several different light sources in an easy to access single assembly.

Yet another object of the present invention is to provide a new boat light system which includes a housing with opposite top and bottom ends. A lower extent downwardly extends from the bottom end of the housing. The lower extent has an electrical plug for electrically connecting to an electrical power supply. A pair of elongate light sources are mounted in the housing and electrically connected to the electrical plug. An upper extent is upwardly extended from the top end of the housing and has a stage coupled thereto. An upper light source is mounted to the stage and is electrically connected to the electrical plug.

Still yet another object of the present invention is to provide a new boat light system that has a white light fluorescent bulb, a black light fluorescent bulb, and an incandescent bulb to allow a user on a boat to easily access them.

Even still another object of the present invention is to provide a new boat light system that provides improved vision at low light conditions on a boat.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is give to the following detailed description thereof. Such description makes reference to the annexed drawings wherein.

DESCRIPTION OF THE PREFERRED EMBODIMENT

Figure 1:
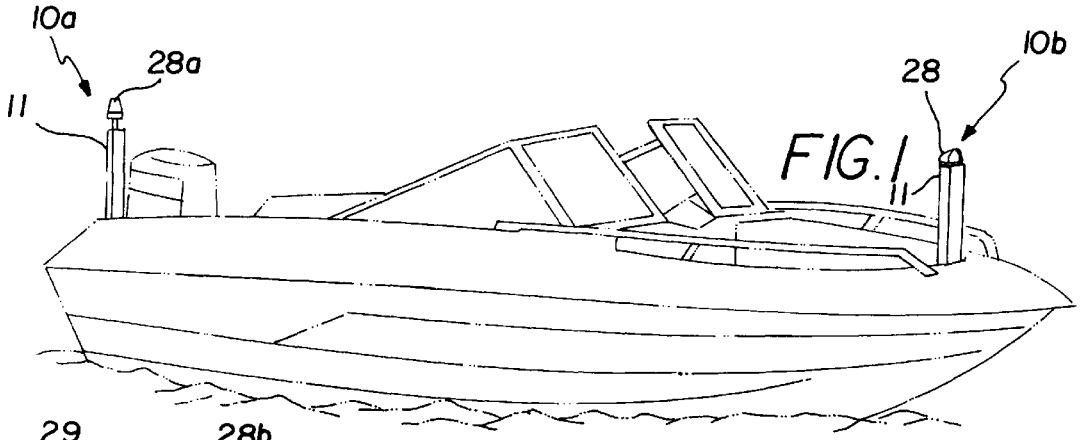
FIG. 1 is a schematic perspective view of a new boat light system in use according to the present invention.
Figure 2:
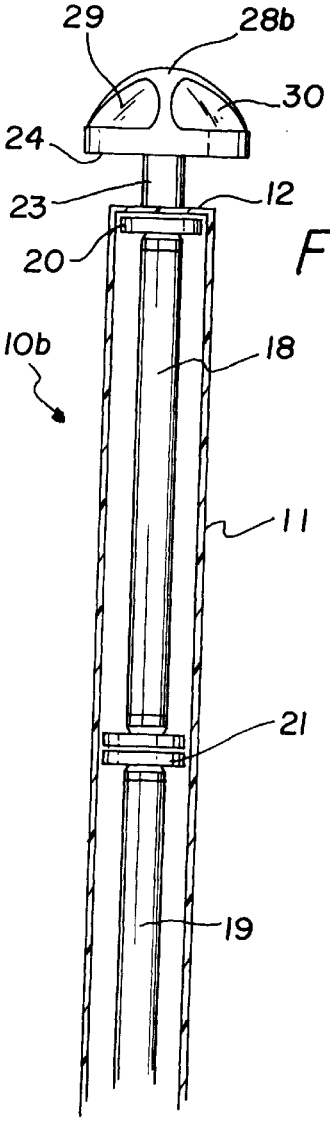
FIG. 2 is a schematic front view of an upper region of an embodiment of the present invention for mounting to the front of a boat.
Figure 3:
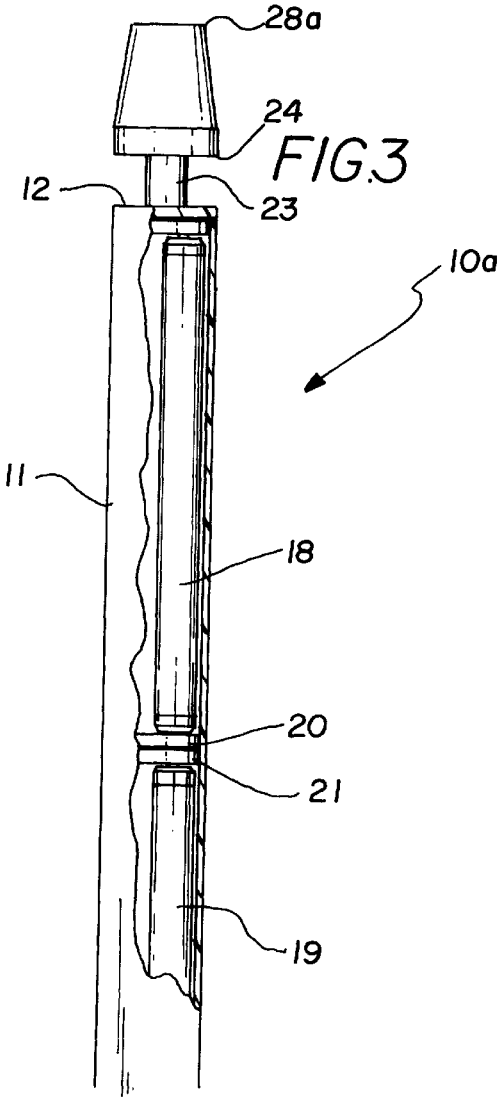
FIG. 3 is a schematic breakaway side view of an upper region of an embodiment of the present invention for mounting to the rear of a boat.
Figure 4:
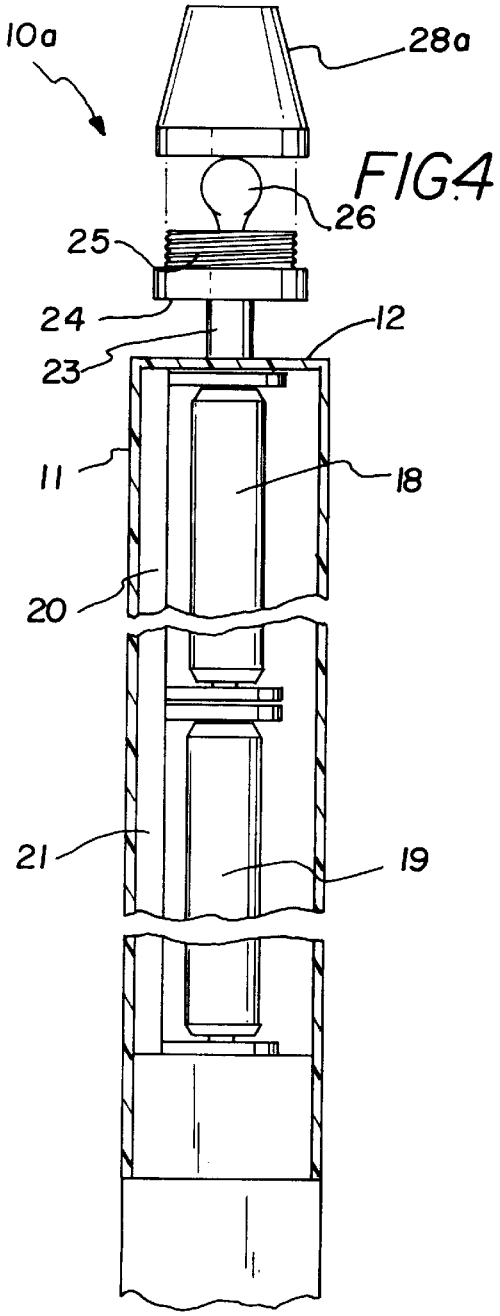
FIG. 4 is a schematic exploded cross sectional view of an upper region of the embodiment of the present invention illustrated in FIG. 3.
Figure 5:
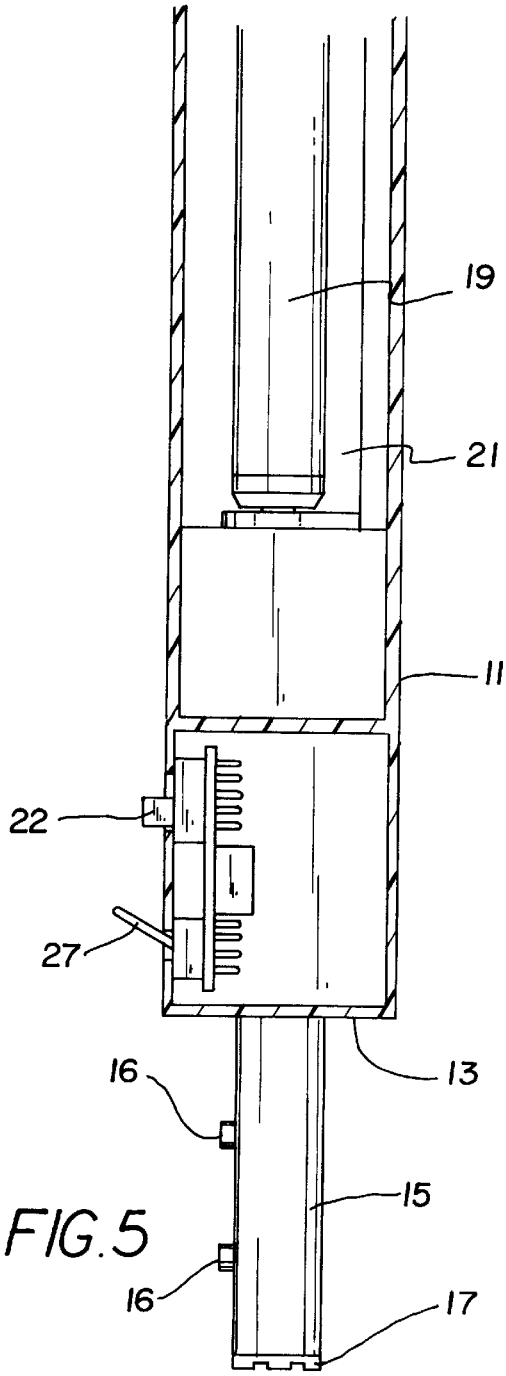
FIG. 5 is a schematic cross sectional view of a lower region of the present invention.

With reference now to the drawings, and in particular to FIGS. 1 through 5 thereof, a new boat light system embodying the principles and concepts of the present invention will be described.

As best illustrated in FIGS. 1 through 5, the boat light system generally comprises a housing with opposite top and bottom ends. A lower extent downwardly extends from the bottom end of the housing. The lower extent has an electrical plug for electrically connecting to an electrical power supply. A pair of elongate light sources are mounted in the housing and electrically connected to the electrical plug. An upper extent is upwardly extended from the top end of the housing and has a stage coupled thereto. An upper light source is mounted to the stage and is electrically connected to the electrical plug.

In close detail, each boat light 10*a*,10*b* comprises an elongate housing 11 having opposite top and bottom ends 12,13. The housing may be tubular and preferably comprises a translucent material and ideally transparent material such as the material sold under the trade name LEXAN. This allows light to shine out through the housing.

A lower extent 15 downwardly extends from the bottom end of the housing. Preferably, the housing and the lower extent are coaxial with one another. The lower extent ideally comprises a metal material such as aluminum for durability and light weight. In use, the lower extent is designed for insertion into a receiving socket of a boat located at either the front or rear of the boat. The lower extent preferably has a spaced apart pair of locating pins 16 outwardly extending transversely therefrom. In use, the locating pins are designed for insertion into corresponding locating holes the receiving socket of the boat.

The lower extent also has an electrical plug 17 at a lower end of the lower extent. The electrical plug is designed for electrically connecting to an electrical power supply via an electrical receptacle in the receiving socket of the boat.

A pair of elongate light sources 18,19 disposed in the housing and is mounted to the housing by a pair of mounting bars 20,21 opposite the opening of the housing. The elongate light sources are electrically connected to the electrical plug of the lower extent via the mounting bars. The elongate light sources are preferably extended collinearly with one another and parallel to the length of the housing. In use, the elongate light sources emit fluorescent light when energized. Preferably, the elongate light sources each comprise a fluorescent light bulb. Ideally, a first of the elongate light sources 18 emits black light fluorescent light and a second of the elongate light sources 19 emits white light fluorescent light. In this ideal embodiment, the first elongate light source is preferably positioned adjacent the top end of the housing and the second elongate light source is preferably positioned adjacent the bottom end of the housing.

A first switch 22 is electrically connected to the elongate light sources for selectively energizing the elongate light sources. The first switch is mounted to the housing adjacent the bottom end of the housing. The first switch preferably comprises a three way switch with an off position, a first elongate light source on position and a second elongate light source on position.

An upper extent 23 upwardly extends from the top end of the housing. A stage 24 is coupled to an upper end of the upper extent above the top end of the housing. The stage preferably has a threaded perimeter lip 25 therearound.

An upper light source 26 is mounted to the stage and is electrically connected to the electrical plug of the lower extent. Preferably, the upper light source comprises an incandescent light bulb. A second switch 27 is electrically connected to the upper light source for selectively energizing the upper light source. The second switch is mounted to the housing adjacent the bottom end of the housing.

A top cap 28*a*,28*b* is preferably threadably coupled to the threaded perimeter lip of the stage to substantially cover the upper light source. The top cap 28*a* of a first of the boat lights 10*a* preferably comprises a translucent material and has a generally frusta-conical configuration. This first boat light is designed for mounting in a receiving socket at a rear of a boat.

The top cap 28*b* of a second of the boat lights 10*b* is preferably generally dome-shaped and has a pair of translucent windows 29,30. The windows of the top cap of the second boat light are preferably tinted visibly distinguishable colors with respect to one another. Ideally, one of the windows is tinted a green color and the other of the windows is tinted a red color. In use, the second boat light is designed for mounting in a receiving socket at a front of a boat.

In an ideal illustrative embodiment, each boat light has a length defined from the plug to the top cap of about 44 inches to upwardly extend the boat lights a distance above the boat to optimally shine light.

The boat lights are designed for use on a boat 31 having a front 32 and a rear 33, and a pair of receiving sockets. One of the receiving sockets is positioned adjacent the front of the boat and the other of the receiving sockets is positioned adjacent the rear of the boat. Each of the receiving sockets has therein a pair of locating holes and an electrical receptacle electrically connected to an electrical power supply of the boat. The first boat light is mounted to the rear of the boat by insertion of the lower extent of the first boat light into the receiving socket of the rear of the boat. Similarly, the second boat light is mounted to the front of the boat by insertion of the lower extent of the second boat light into the receiving socket of the front of the boat.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A boat light, comprising:

a housing having opposite top and bottom ends;

a lower extent downwardly extending from said bottom end of said housing;

said lower extent having an electrical plug for electrically connecting to an electrical power supply;

a pair of elongate light sources being mounted in said housing and electrically connected to said electrical plug;

an upper extent being upwardly extended from said top end of said housing;

a stage being coupled to said upper extent;

an upper light source being mounted to said stage and being electrically connected to said electrical plug;

wherein said elongate light sources each comprise a fluorescent light bulb; and wherein a first of said elongate light sources emits black light fluorescent light, and a second of said elongate light sources emits white light fluorescent light.

2. The boat light of claim 1, wherein said housing comprises a translucent material.

3. The boat light of claim 1, wherein said lower extent has a spaced apart pair of locating pins outwardly extending transversely therefrom.

4. The boat light of claim 1, wherein said elongate light sources are extended collinearly with one another and parallel to said housing, one of said elongate light sources being positioned adjacent said top end of said housing and the other of said elongate light sources being positioned adjacent said bottom end of said housing.

5. The boat light of claim 1, wherein said first elongate light source is positioned adjacent said top end of said housing, and wherein said second elongate light source is positioned adjacent said bottom end of said housing.

6. The boat light of claim 1, wherein said upper light source comprises an incandescent light bulb.

7. A boat light system, comprising:

a plurality of boat lights each comprising:

an elongate housing having opposite top and bottom ends;

said housing comprising a translucent material;

a lower extent downwardly extending from said bottom end of said housing, said housing and said lower extent being coaxial with one another;

said lower extent having a spaced apart pair of locating pins outwardly extending transversely therefrom;

said lower extent having an electrical plug at a lower end of said lower extent, said electrical plug being adapted for electrically connecting to an electrical power supply;

a pair of elongate light sources being disposed in said housing and being mounted to said housing opposite said opening of said housing;

said light sources being electrically connected to said electrical plug of said lower extent;

said elongate light sources being extended collinearly with one another and parallel to said housing;

wherein said elongate light sources each comprise a fluorescent light bulb to emit fluorescent light when energized;

a first of said elongate light sources emitting black light fluorescent light, a second of said elongate light sources emitting white light fluorescent light;

said first elongate light source being positioned adjacent said top end of said housing, said second elongate light source being positioned adjacent said bottom end of said housing;

a first switch being electrically connected to said elongate light sources for selectively energizing said elongate light sources;

said first switch being mounted to said housing adjacent said bottom end of said housing;

an upper extent being upwardly extended from said top end of said housing;

a stage being coupled to an upper end of said upper extent above said top end of said housing, said stage having a threaded perimeter lip therearound;

an upper light source being mounted to said stage and being electrically connected to said electrical plug of said lower extent;

said upper light source comprising an incandescent light bulb;

a second switch being electrically connected to said upper light source for selectively energizing said upper light source;

said second switch being mounted to said housing adjacent said bottom end of said housing;

a top cap being threadably coupled to said threaded perimeter lip of said stage to substantially cover said upper light source;

said top cap of a first of said boat lights comprising a translucent material and having a generally frustaconical configuration;

said top cap of a second of said boat lights being generally dome-shaped and having a pair of translucent windows;

said windows of said top cap of said second boat light being tinted visibly distinguishable colors with respect to one another, wherein one of said windows is tinted a green color and the other of said windows is tinted a red color;

a boat having a front and a rear;

said lower extent of said first boat light being mounted to said rear of the boat; and said lower extent said second boat light being mounted to said front of the boat.

8. A boat light, comprising a housing having opposite top and bottom ends;

a lower extent downwardly extending from said bottom end of said housing;

said lower extent having an electrical plug for electrically connecting to an electrical power supply;

a pair of elongate light sources being mounted in said housing and electrically connected to said electrical plug;

an upper extent being upwardly extended from said top end of said housing;

a stage being coupled to said upper extent;

an upper light source being mounted to said stage and being electrically connected to said electrical plug;

wherein a top cap is coupled to said stage to substantially cover said upper light source; and wherein said top cap is generally dome-shaped and has a pair of translucent windows.

9. The boat light of claim 8, wherein said top cap comprises a translucent material and has a generally frustaconical configuration.

10. The boat light of claim 8, wherein said windows of said top cap of said second boat light are tinted visibly distinguishable colors with respect to one another.

11. The boat light of claim 10, wherein one of said windows is tinted a green color and the other of said windows is tinted a red color.

* * * * *